US007720399B2

(12) United States Patent
Takahashi

(10) Patent No.: US 7,720,399 B2
(45) Date of Patent: May 18, 2010

(54) IMAGE FORMING APPARATUS CONTROLLING TRANSFER OUTPUT IN ACCORDANCE WITH VARIATION OF ENVIRONMENT CONDITIONS

(75) Inventor: Yoshihiko Takahashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 159 days.

(21) Appl. No.: 11/984,967

(22) Filed: Nov. 26, 2007

(65) Prior Publication Data

US 2008/0124101 A1 May 29, 2008

(30) Foreign Application Priority Data

Nov. 28, 2006 (JP) ..... 2006-320427

(51) Int. Cl.
*G03G 15/00* (2006.01)
*G03G 15/16* (2006.01)

(52) U.S. Cl. ..... 399/44; 399/45; 399/66

(58) Field of Classification Search ..... 399/66, 399/44, 45

See application file for complete search history.

(56) References Cited

U.S. PATENT DOCUMENTS 5,276,483 A * 1/1994 Hasegawa et al. ..... 399/44
5,649,265 A * 7/1997 Tabuchi ..... 399/44
5,903,798 A * 5/1999 Yokogawa et al. ..... 399/66
5,909,605 A * 6/1999 Nishizawa et al. ..... 399/66
6,047,144 A * 4/2000 Sasai et al. ..... 399/44
6,728,498 B2 * 4/2004 Takeuchi ..... 399/69
2003/0072578 A1 * 4/2003 Boothe et al. ..... 399/44
2008/0181636 A1 * 7/2008 Izumi ..... 399/44

FOREIGN PATENT DOCUMENTS

JP 2000-235316 8/2000

* cited by examiner

*Primary Examiner*—Sophia S Chen
(74) *Attorney, Agent, or Firm*—Rabin & Berdo, P.C.

(57) ABSTRACT

An image forming apparatus includes an image bearing body that bears a developer image, a transfer member for transferring the developer image to a recording medium, a storing section in which a stored temperature value and a stored electric resistance value of the transfer member are stored, a temperature detecting section that detects a temperature of the transfer member, a calculating section that calculates a temperature variation value, a comparing-and-determining section that determines whether the temperature variation value is less than a temperature variation threshold, an output control section that determines a transfer output based on the stored electric resistance value stored in the storing section in the case where the temperature variation value is less than the temperature variation threshold, and an output applying section that applies the transfer output to the transfer member.

9 Claims, 13 Drawing Sheets

FIG.5

| | | DETECTED ENVIRONMENTAL HUMIDITY VALUE h (%) | | | | | | | | |
|---|---|---|---|---|---|---|---|---|---|---|
| | | h<15 | 15≦h<25 | 25≦h<35 | 35≦h<45 | 45≦h<55 | 55≦h<65 | 65≦h<75 | 75≦h<85 | 85≦h |
| DETECTED ENVIRONMENTAL TEMPERATURE VALUE t (℃) | t<5 | 8 | 8 | 8 | 7 | 7 | 7 | 7 | 6 | 6 |
| | 5≦t<10 | 8 | 8 | 8 | 7 | 7 | 6 | 6 | 5 | 5 |
| | 10≦t<15 | 8 | 8 | 7 | 7 | 6 | 5 | 5 | 4 | 4 |
| | 15≦t<20 | 8 | 7 | 7 | 6 | 5 | 4 | 4 | 3 | 3 |
| | 20≦t<25 | 7 | 7 | 6 | 5 | 4 | 4 | 3 | 3 | 2 |
| | 25≦t<30 | 7 | 6 | 5 | 4 | 4 | 3 | 1 | 1 | 1 |
| | 30≦t<35 | 7 | 6 | 5 | 4 | 2 | 1 | 1 | 1 | 1 |
| | 35≦t<40 | 6 | 6 | 4 | 2 | 1 | 1 | 1 | 1 | 1 |
| | 40≦t | 6 | 5 | 4 | 2 | 1 | 1 | 1 | 1 | 1 |

FIG.6

| ENVIRONMENT DETECTION VALUE E | TEMPERATURE VARIATION THRESHOLD ΔTth (℃) |
|---|---|
| 1~2 | 10 |
| 3~6 | 8 |
| 7~8 | 5 |

FIG.8

(unit kV)

| PRINTING INFORMATION | | | DETECTED ENVIRONMENT VALUE E | | | | | | | |
|---|---|---|---|---|---|---|---|---|---|---|
| MEDIUM TYPE | MEDIUM THICKNESS | color | 1 | 2 | 3 | 4 | 5 | 6 | 7 | 8 |
| NORMAL PAPER | THICK PAPER | K | 2.49 | 2.78 | 3.05 | 3.18 | 3.37 | 3.43 | 3.62 | 4.2 |
| | | Y | 2.58 | 2.84 | 3.07 | 3.24 | 3.37 | 3.46 | 3.64 | 4.2 |
| | | M | 2.69 | 2.93 | 3.13 | 3.29 | 3.41 | 3.49 | 6.65 | 4.2 |
| | | C | 2.81 | 3.03 | 3.21 | 3.35 | 3.45 | 3.52 | 3.67 | 4.25 |
| ⋮ | ⋮ | ⋮ | ⋮ | | | | | | | |

FIG.11

| DETECTED ELECTRIC RESISTANCE OF TRANSFER ROLLER (μA) | TRANSFER VOLTAGE OUTPUT VALUE (KV) | EVALUATION RESULT OF IMAGE QUALITY (EXCELLENT OR NOT) |
|---|---|---|
| 4.4 | 3.12 | × |
| 4.4 | 3.32 | ○ |
| 4.4 | 3.52 | ○ |
| 4.4 | 3.72 | × |
| 6.4 | 2.90 | × |
| 6.4 | 3.10 | ○ |
| 6.4 | 3.30 | ○ |
| 6.4 | 3.50 | × |
| 7.6 | 2.72 | × |
| 7.6 | 2.92 | ○ |
| 7.6 | 3.12 | ○ |
| 7.6 | 3.32 | × |

IMAGE FORMING APPARATUS CONTROLLING TRANSFER OUTPUT IN ACCORDANCE WITH VARIATION OF ENVIRONMENT CONDITIONS

BACKGROUND OF THE INVENTION

This invention relates to an image forming apparatus that forms an image using electrophotographic technique.

An image forming apparatus that forms a color image using electrophotographic technique includes a plurality of photosensitive drums and corresponding transfer units. The photosensitive drums and transfer units face each other and are disposed along a feeding belt for feeding a recording medium. Toner cartridges are provided for supplying toners of respective colors to the respective photosensitive drums. A latent image is formed on the surface of each photosensitive drum by means of a charging roller and an exposure unit disposed on the circumference of the photosensitive drum. The latent image is developed by the toner, and a toner image is formed on the surface of each photosensitive drum.

When the feeding belt moves, a recording medium is fed through between the respective photosensitive drums and the transfer units. Each transfer unit is applied with a transfer output (i.e., a transfer bias), and the recording medium is applied with an electric charge opposite in polarity to the toner image formed on the surface of the photosensitive drum. The toner image is transferred from the surface of the photosensitive drum to the recording medium. Thereafter, the recording medium is fed to a fixing unit. The fixing unit applies heat and pressure to the toner image, so that the toner image is fixed to the recording medium.

Conventionally, a "differential constant current controlling method" is known as a method for controlling the transfer output applied to the transfer unit. In the differential constant current controlling method, a target current flowing through a transfer unit is predetermined, and the transfer output applied to the transfer unit is determined while detecting the feedback current so that the feedback current becomes equal to the target current. Further, the transfer output is controlled in accordance with the preliminarily detected electric resistance of the transfer unit.

Therefore, Japanese Laid-Open Patent publication No. 2000-235316 discloses a technique in which an amount of variation (i.e., variation with time) of the electric resistance of the feeding belt is detected, and the transfer output is controlled according to the detected amount of variation.

However, in the above described technique, the detection of the variation of the electric resistance of the feeding belt is performed irrespective of whether there is a variation of the temperature or not. Therefore, there is a problem that it takes a long time to start printing operation.

Accordingly, it is demanded to develop an image forming apparatus capable of controlling the transfer output quickly and correctly in accordance with the variation of the environmental condition such as temperature, humidity or the like.

SUMMARY OF THE INVENTION

The present invention is intended to solve the above described problems, and an object of the present invention is to provide an image forming apparatus capable of controlling the transfer output quickly and correctly in accordance with the variation of the environmental condition such as temperature, humidity or the like.

The present invention provides an image forming apparatus including:

an image bearing body that bears a developer image;

a transfer member for transferring the developer image to a recording medium;

a storing section in which a stored temperature value and a stored electric resistance value of the transfer member are preliminarily stored;

a temperature detecting section that detects a temperature of the transfer member;

a calculating section that calculates a temperature variation value representing a variation between a detected temperature value detected by the temperature detecting section and the stored temperature value stored in the storing section;

a comparing-and-determining section that compares the temperature variation value and a predetermined temperature variation threshold and determines whether the temperature variation value is less than the temperature variation threshold or not;

an output control section that determines a transfer output based on the stored electric resistance value stored in the storing section, in the case where the comparative determining section determines that the temperature variation value is less than the temperature variation threshold, and an output applying section that applies the transfer output to the transfer member.

With such an arrangement, when the variation value of the temperature (between the detected temperature value and the stored temperature value of the transfer member) is less than the predetermined temperature variation threshold, the transfer output having been previously determined is applied to the transfer member, and then the image formation is performed. In such a case, the determination process of the transfer output can be omitted, and therefore the process time can be shortened. Further, the transfer output can be controlled without detecting the electric resistance of the transfer unit by applying an output to the transfer member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 5 is an illustrative view showing an example of an environment detection table;

FIG. 6 is an illustrative view showing an example of a threshold storing section;

FIG. 8 is an illustrative view showing an example of a transfer voltage table;

FIG. 11 shows the result of evaluation of image quality;

DETAILED DESCRIPTION OF THE PREFERRED EMBODIMENT

Hereinafter, an embodiment of the present invention will be described with reference to the attached drawings.

Figure 2:
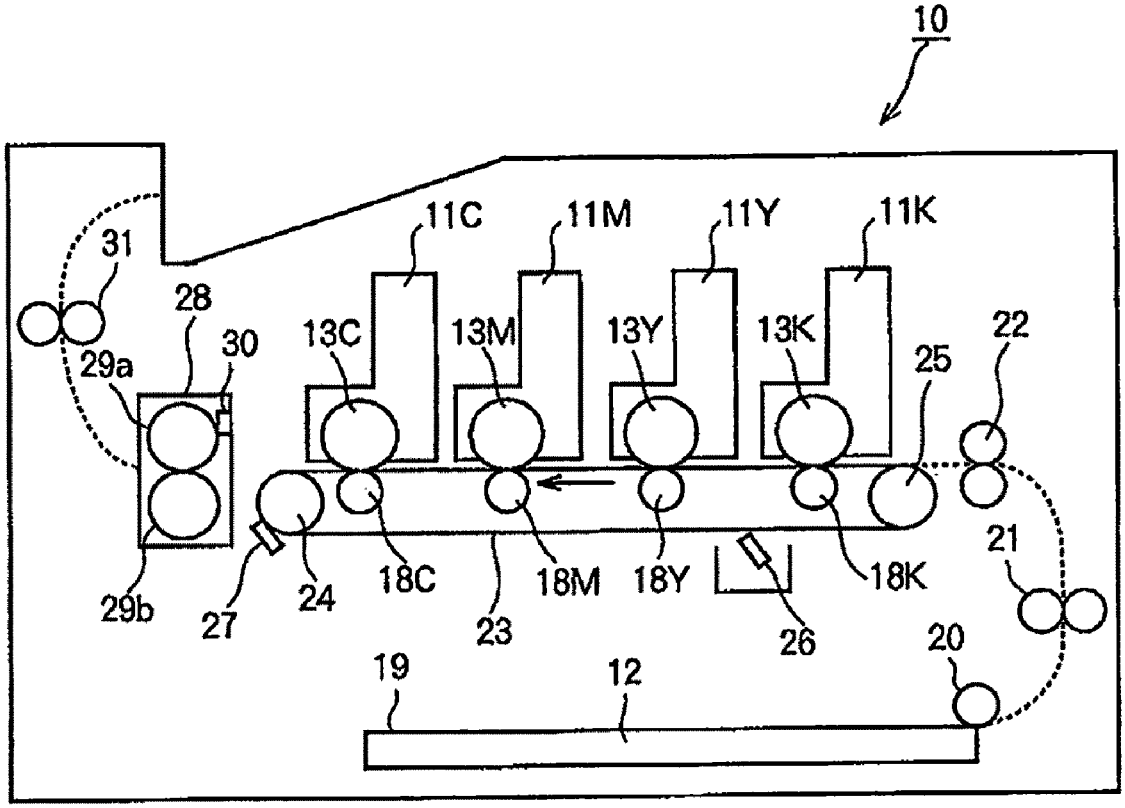
FIG. 2 is a schematic view showing the printer according to the embodiment of the present invention.

FIG. 2 is a schematic view showing a configuration of a printer according to the embodiment of the present invention.

In FIG. 2, a recording medium storing cassette 19 is provided on the lower part of a printer 10 as an image forming apparatus. The recording medium storing cassette 19 stores a plurality of recording media 12. The printer 10 includes a hopping roller 20 that feeds the recording medium 12 out of the recording medium storing cassette 19 sheet by sheet, and first and second registration rollers 21 and 22 that further feed the recording medium 12 along a feeding path.

Along the feeding path of the recording medium 12, four image forming units 11K, 11Y, 11M and 11C are disposed in this order in the feeding direction of the recording medium 12.

The image forming unit 11K includes a photosensitive drum 13K as an image bearing body having a surface on which a black image can be formed. Similarly, the image forming unit 11Y includes a photosensitive drum 13Y on which a yellow image can be formed, the image forming unit 11M includes a photosensitive drum 13M on which a magenta image can be formed, and the image forming unit 11C includes a photosensitive drum 13C on which a cyan image can be formed.

Figure 3:
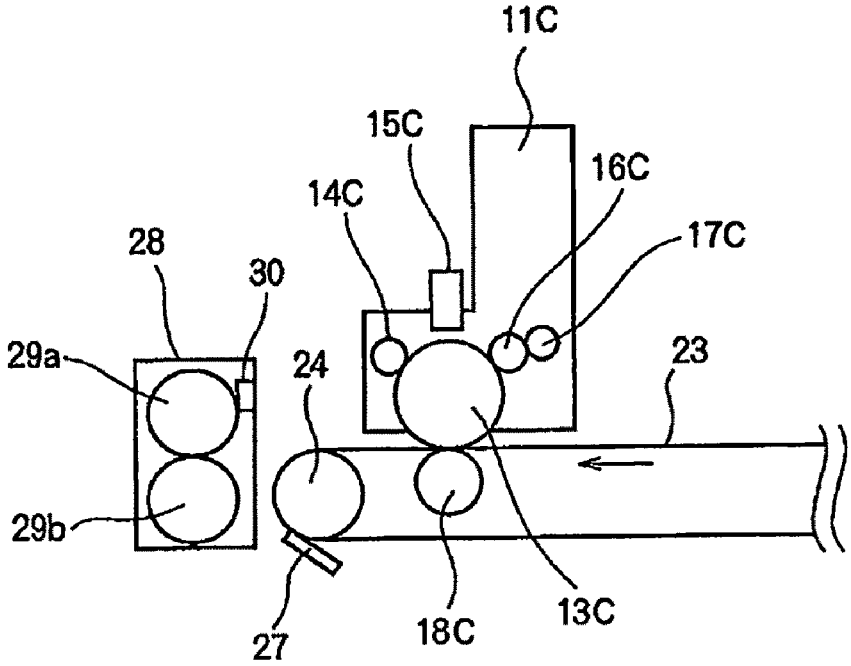
FIG. 3 is an enlarged view of a cyan image forming unit of the printer of FIG. 2 and its surroundings.

FIG. 3 is an enlarged view showing the image forming unit 11C (i.e., the cyan image forming unit) and its surroundings.

As shown in FIG. 3, the cyan image forming unit 11C includes a charging roller 14C, an LED head 15C and a developing roller 16C disposed around the photosensitive drum 13C. The charging roller 14C uniformly charges the surface of the photosensitive drum 13C, the LED head 15C forms a latent image on the surface of the photosensitive drum 13C, and the developing roller 16C develops the latent image to form a toner image. Further, a sponge roller 17C is urged against the developing roller 16C, which causes the cyan toner to adhere to the surface of the developing roller 16C.

A transfer roller 18C as a transfer unit (i.e., a transfer member) is disposed outside the image forming unit 11C. The transfer roller 18C faces the photosensitive drum 13C with the feeding path disposed therebetween.

The image forming units 11K, 11Y and 11M have the similar configurations as the image forming unit 11C.

Along the feeding path of the recording medium 12, a transfer belt 23 (i.e., a feeding member) is stretched around a driving roller 24 and a driving auxiliary roller 25. The transfer belt 23 is composed of a semi-conductive plastic film having high electric resistance, and has a seamless and endless form. When the driving roller 24 is rotated by a belt motor 58 (described later), the transfer belt 23 is driven in the direction indicated by an arrow shown in FIGS. 2 and 3. A cleaning blade 26 is disposed in contact with the surface of the lower part of the transfer belt 23. When the transfer belt 23 is driven, the cleaning blade 26 scrapes the toner debris or the like from the surface of the transfer belt 23.

Figure 4:
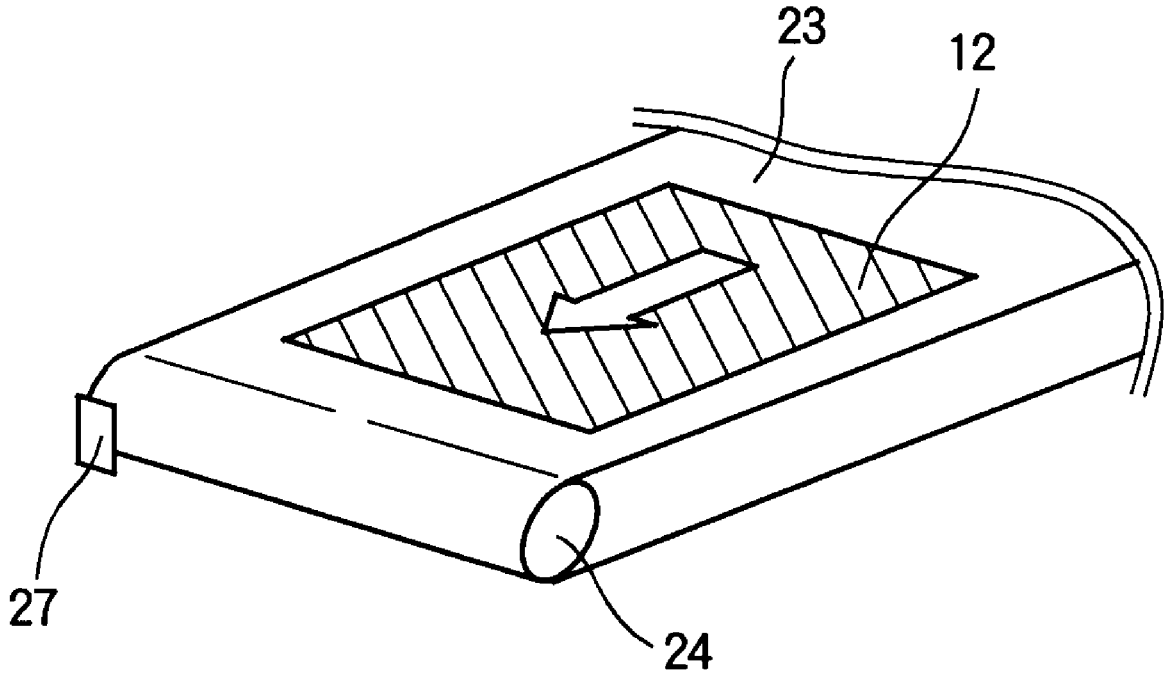
FIG. 4 is a schematic view showing a position of a belt temperature detecting sensor.

Further, a belt temperature detecting sensor 27 as a temperature detecting section is disposed in contact with the surface of the lower part of the transfer belt 23 (see FIG. 4).

FIG. 4 is a schematic view showing the position of the belt temperature detecting sensor 27 according to the embodiment.

The belt temperature detecting sensor 27 is composed of a thermistor for detecting the temperature of the transfer belt 23. In order to prevent the abrasion of the surface of the transfer belt 23 (that may cause defective transferring) due to the sliding contact with the transfer belt 23, and to prevent the toner from adhering to the belt temperature detecting sensor 27 itself, the belt temperature detecting sensor 27 is disposed on a portion of the transfer belt 23 that does not contact the recording medium 12. In this embodiment, the belt temperature detecting sensor 27 is disposed at the lower end portion of the transfer belt 23 and at the downstream end in the feeding direction (indicated by an arrow in FIG. 4) of the recording medium 12 as shown in FIG. 4.

The recording medium 12 is fed by the second registration roller 22, and is placed on the upper surface of the transfer belt 23. When the transfer belt 23 is driven to move, the recording medium 12 is first fed through between the photosensitive drum 13K and the transfer roller 18K. In this state, the transfer roller 18K is applied with a transfer output (i.e., a transfer bias), and the black toner image formed on the surface of the photosensitive drum 13K is transferred to the surface of the recording medium 12. Subsequently, the recording medium 12 is fed through between the respective photosensitive drums 13Y, 13M and 13C and the transfer rollers 18Y, 18M and 18C, and the toner images of the respective colors are transferred to the recording medium 12. Then, the recording medium 12 to which the toner images of four colors have been transferred is fed to a fixing unit 28 by the transfer belt 23.

The fixing unit 28 includes heat rollers 29*a* and 29*b* and a fixing unit temperature detecting sensor 30. The fixing unit temperature detecting sensor 30 includes a thermistor that detects the temperature of the heat rollers 29*a* and 29*b*. The recording medium 12 fed into the fixing unit 28 is heated and pressed by the heat rollers 29*a* and 29*b*, and the toner images of the respective colors are fixed to the recording medium 12. Then, the recording medium 12 to which toner images of four colors have been fixed is fed to an ejection opening by ejection rollers 31.

Next, the control system of the printer 10 will be described.

Figure 1:
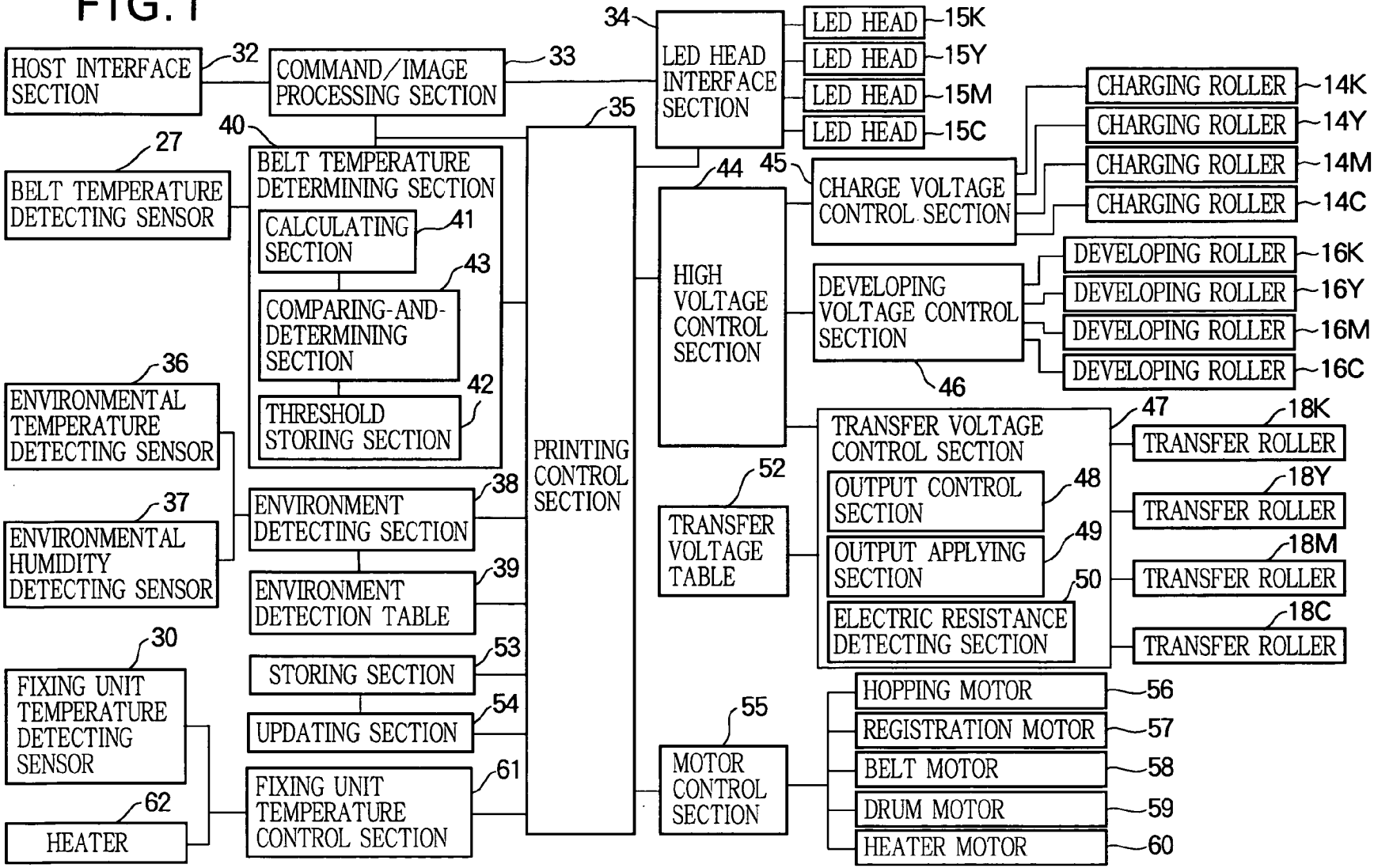
FIG. 1 is a block diagram showing a functional configuration of a printer according to the embodiment of the present invention.

FIG. 1 is a block diagram showing a functional configuration of the printer according to the embodiment of the present invention.

A host interface section 32 has a function to interface with a host device (not shown) at the physical layer, and is composed of a connector, a communication chip or the like. The host interface section 32 receives a command to perform a printing operation, an image data to be printed or the like from the host device, and sends the same to a command/image processing section 33.

The command/image processing section 33 interprets the command received from the host device via the host interface section 32, and expands the image data into a bitmap data. The command/image processing section 33 includes a micro processor, RAM and the like. The command interpreted by the command/image processing section 33 is sent to a printing control section 35. The image data expanded by the command/image processing section 33 is sent to an LED head interface section 34.

The LED head interface section 34 has a function to process the image data (received from the command/image processing section 33) in accordance with the interface of the respective LED heads 15K, 15Y, 15M and 15C. The LED head interface section 34 is composed of a semicustom LSI, RAM and the like.

A motor control section 55 controls and drives a hopping motor 56, a registration motor 57, the belt motor 58, a drum motor 59, a heater motor 60 and the like.

The hopping motor 56 functions as a driving unit for driving the hopping roller 20. The registration motor 57 drives the first and second registration rollers 21 and 22. The belt motor 58 drives the driving roller 24 to thereby move the transfer belt 23. The drum motor 59 drives the photosensitive drums 13K, 13Y, 13M and 13C of the respective image forming units 11K, 11Y, 11M and 11C. The heater motor 60 drives the heat rollers 29*a* and 29*b* of the fixing unit 28.

A fixing unit temperature control section 61 controls the temperature of the fixing unit 28 based on the temperature of the heat rollers 29*a* and 29*b* detected by the fixing unit temperature detecting sensor 30.

Heaters 62 composed of halogen lamps are provided in the heat rollers 29*a* and 29*b* shown in FIGS. 2 and 3. The heaters 62 are supplied with electric power from an electric power supply section (not shown) controlled by the fixing unit temperature control section 61, and heat the heat rollers 29*a* and 29*b*.

An environmental-temperature detecting sensor 36 (i.e., an environmental-temperature detecting section) composed of a thermistor that detects the temperature in the printer 10 as a detected environmental-temperature value t. An environmental-humidity detecting sensor 37 (i.e., an environmental-humidity detecting section) detects the humidity in the printer 10 as a detected environmental-humidity value h. In this embodiment, the environmental-temperature detecting sensor 36 and the environmental-humidity detecting sensor 37 are mounted on a high voltage board (not shown) provided on the side of the printer 10.

An environment detecting section 38 monitors the inputs from the environmental-temperature detecting sensor 36 and the environmental-humidity detecting sensor 37, and obtains an environment detection value E based on the respective input values and an environment detection table 39 described later. The environment detecting section 38 sends the environment detection value E to the printing control section 35 described later.

FIG. 5 is an illustrative view showing an example of the environment detection table.

In the environment detection table 39, the environment detection values E are stored corresponding to respective ranges of the detected environmental-temperature value t and the respective ranges of the detected environmental-humidity value h as shown in FIG. 5. The environment detection value E is a numeric value that represents the environmental condition of the transferring in the printer 10. The environment detection value E is used for setting the temperature variation threshold (described later) in a belt temperature determining section 40, for controlling the transfer voltage in a transfer voltage control section 47, or the like.

For example, when the detected environmental-temperature value t is 12° C. and the detected environmental-humidity value h is 20%, the environment detecting section 38 chooses and obtains the environment detection value E of 8 (E=8) in accordance with the environment detection table 39. When the detected environmental-temperature value t is 22° C. and the detected environmental-humidity value h is 40%, the environment detecting section 38 obtains the environment detection value E of 5 (E=5). When the detected environmental-temperature value t is 28° C. and the detected environmental-humidity value h is 70%, the environment detecting section 38 obtains the environment detection value E of 1 (E=1).

The belt temperature determining section 40 includes a calculating section 41, a threshold storing section 42, and a comparing-and-determining section 43. The belt temperature determining section 40 has a function to control the belt temperature detection sensor 27 to detect the temperature of the transfer belt 23.

The calculating section 41 calculates a temperature variation value $\Delta T=|T-To|$ representing the amount of variation of the temperature of the transfer belt 23 based on the temperature (i.e., the detected temperature value T) of the transfer belt 23 detected by the belt temperature detecting sensor 27 and the temperature (i.e., the stored temperature value $T_O$) of the transfer belt 23 stored in a storing section 53 described later.

The threshold storing section 42 stores temperature variation threshold $\Delta T_{th}$ representing a threshold of the temperature variation value $\Delta T$.

FIG. 6 is an illustrative view showing the configuration of the threshold storing section 42.

In the threshold storing section 42, temperature variation thresholds $\Delta T_{th}$ are stored corresponding to respective ranges of the environment detection value E.

For example, the threshold storing section 42 stores the temperature variation threshold $\Delta T_{th}$ of 10° C. corresponding to the range of the environment detection value E from 1 to 2. The threshold storing section 42 stores the temperature variation threshold $\Delta T_{th}$ of 8° C. corresponding to the range of the environment detection value E from 3 to 6, and the threshold storing section 42 stores the temperature variation threshold $\Delta T_{th}$ of 5° C. corresponding to the range of the environment detection value E from 7 to 8.

The setting of the temperature variation threshold $\Delta T_{th}$ to be stored in the threshold storing section 42 will be described later.

The comparing-and-determining section 43 chooses (and sets) the temperature variation threshold $\Delta T_{th}$ from the threshold storing section 42 according to the environment detection value E detected by the environment detecting section 38. The comparing-and-determining section 43 compares the temperature variation threshold $\Delta T_{th}$ and the temperature variation value $\Delta T$ calculated by the calculating section 41, and determines whether the temperature variation value $\Delta T$ is less than the temperature variation threshold $\Delta T_{th}$. The determination result of the comparing-and-determining section 43 is notified to the printing control section 35.

For example, in the case where the environment detecting section 38 detects the environment detection value E of 1, the comparing-and-determining section 43 chooses (and sets) the temperature variation threshold $\Delta T_{th}$ of 10° C. based on the threshold storing section 42. Then, the comparing-and-determining section 43 determines whether the temperature variation value $\Delta T$ (calculated by the calculating section 41) is less than 10° C. or not.

A high-voltage control section 44 is composed of a micro processor or a custom LSI. The high-voltage control section 44 controls a charge voltage control section 45, a developing voltage control section 46 and a transfer voltage control section 47 so as to control charge voltages, developing voltages and transfer voltages for the respective image forming units 11K, 11Y, 11M and 11C.

The charge voltage control section 45 controls the supply (and the stoppage of supply) of the charge voltages applied to the charging rollers 14K, 14Y, 14M and 14C.

The developing voltage control section 46 controls the supply (and the stoppage of supply) of the developing voltages applied to the developing rollers 16K, 16Y, 16M and 16C.

The transfer voltage control section 47 controls the supply (and the stoppage of supply) of the transfer voltages applied to the transfer rollers 18K, 18Y, 18M and 18C, and includes an output control section 48, an output applying section 49 and an electric resistance detecting section 50.

Figure 7:
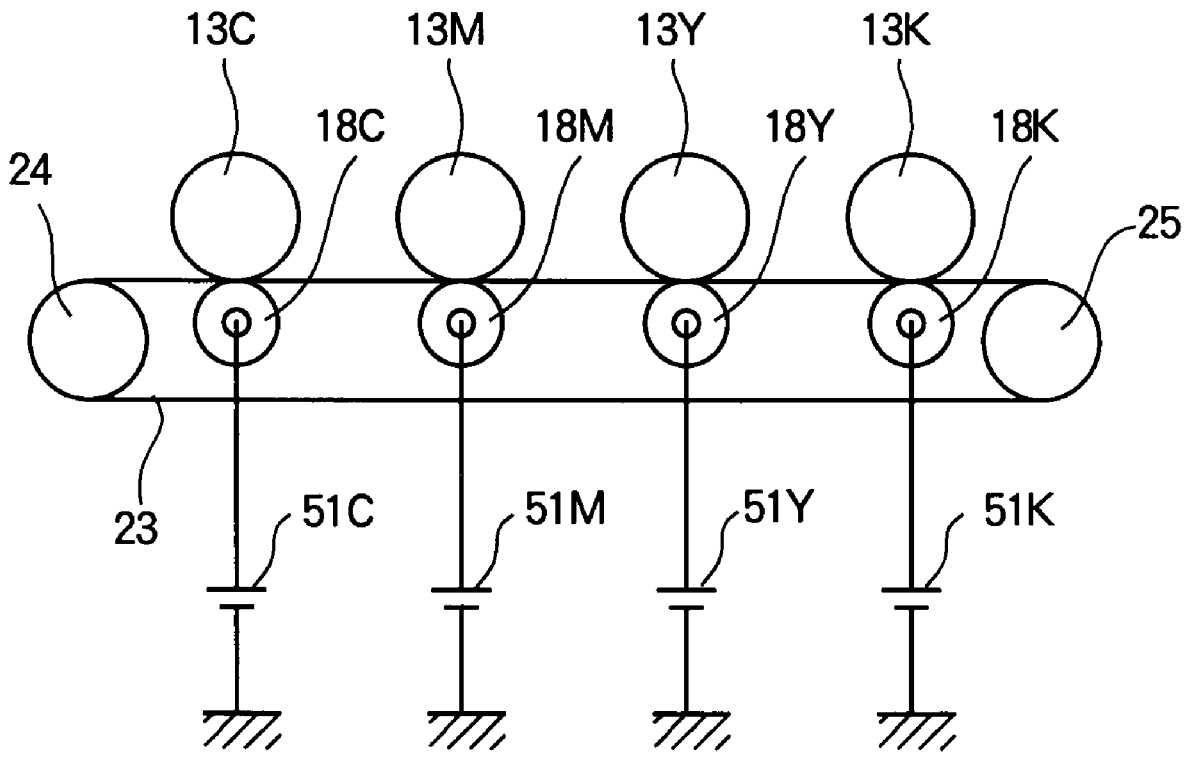
FIG. 7 is a schematic view showing a transfer circuit.

FIG. 7 is a schematic view showing a transfer circuit.

Transfer voltage power sources 51K, 51Y, 51M and 51C have a function as the transfer voltage control section 47, and are respectively connected to the transfer rollers 18K, 18Y, 18M and 18C as shown in FIG. 7. In this embodiment, the transfer voltage power sources 51K, 51Y and 51M are composed of constant-voltage power sources capable of outputting voltages of up to 5 kV. The transfer voltage power source 51C is composed of a constant-voltage power source capable of outputting voltage of up to 7 kV.

The output control section 48 calculates the output values of the transfer voltages (i.e., transfer voltage output values V) to be applied to the respective transfer rollers 18K, 18Y and 18M and 18C based on the electric resistances (i.e., stored electric resistance values $I_O$) of the transfer rollers 18K, 18Y, 18M and 18C stored in the storing section 53 described later, and notifies an output applying section 49 of the transfer voltage output values V. In the calculation of the transfer voltage output value V by the output control section 48, printing information notified by the command/image processing section 33 to the printing control section 35 and the environment detection value E detected by the environment detecting section 38 are used as well as the above described stored electric resistance value $I_O$, and a transfer voltage table 52 is referred.

FIG. 8 is an illustrative view showing an example of the transfer voltage table.

As shown in FIG. 8, the transfer voltage table 52 stores transfer voltage table value V, corresponding to the printing information and the environment detection value E. The printing information stored in the transfer voltage table 52 includes medium-type information (i.e., information of the type of the recording medium 12 used in the printing process) as medium-specification information notified by the printing control section 35 via the high-voltage control section 44, and medium-thickness information (i.e., information of the thickness of the recording medium 12) which is also described as medium-weight information. The printing information further includes color information of the toners used in the respective image forming units 11K, 11Y, 11M and 11C.

In this embodiment, the transfer voltage table 52 stores the transfer voltage table value $V_1$ corresponding to the respective combinations of the color information "K", "Y", "M" and "C" of the toners used in the image forming units 11K, 11Y, 11M and 11C and the environment detection values E ranging from 1 to 8, in association with the respective medium information including the medium-type information ("usual paper") and the medium-thickness information ("thick paper"). For example, if the environment detection value E is 1, the transfer voltage table value $V_1$ stored in the transfer voltage table 52 is 2.49 kV for the transfer roller 18*k* forming black image (i.e., the color information "K") corresponding to the medium-type information of "usual paper" and the medium-thickness information of "thick paper".

The output control section 48 refers to the above described transfer voltage table 52 and obtains the transfer voltage table value $V_1$. The output control section 48 calculates the transfer voltage calculation value $V_2$ based on the stored electric resistance value $I_O$ stored in the storing section 53 described later. Then, the output control section 48 adds the transfer voltage table value $V_1$ and transfer voltage calculation value $V_2$, and obtains the transfer voltage output value $V=V_1+V_2$. The calculated voltage output value V is notified to the output applying section 49.

The output applying section 49 applies the outputs from the high-voltage transformer provided in the respective transfer power sources 51K, 51Y, 51M and 51C to the respective transfer rollers 18K, 18Y, 18M and 18C via the electric resistance of 100 MΩ.

The electric resistance detecting section 50 detects the electric resistances of the respective transfer rollers 18K, 18Y, 18M and 18C (i.e., the detected electric resistance values). To be more specific, the electric resistance detecting section 50 detects the currents flowing through the respective transfer rollers 18K, 18Y, 18M and 18C as the detected electric resistance values I of the transfer rollers 18K, 18Y, 18M and 18C while applying constant transfer voltages to the respective transfer rollers 18K, 18Y, 18M and 18C by means of the output applying section 49. The detected electric resistance values I are sent to the printing control section 35 via the high-voltage control section 44.

The storing section 53 stores the temperature of the transfer belt 23 as the stored temperature value To, and stores the electric resistances of the respective transfer rollers 18K, 18Y, 18M and 18C as the stored electric resistance values $I_o$.

An updating section 54 is controlled by the printing control section 35, and has a function to update the stored temperature value $T_o$ and the stored electric resistance value $I_O$ respectively to the detected temperature value T detected by the belt temperature detecting sensor 27 and the detected electric resistance value I detected by the electric resistance detecting section 50.

The printing control section 35 has a function to control the respective parts of the printer 10 based on the command received from the command/image processing section 33.

Next, the setting of the temperature variation threshold $\Delta T_{th}$ to be stored in the threshold storing section 42 will be described.

Figure 9:
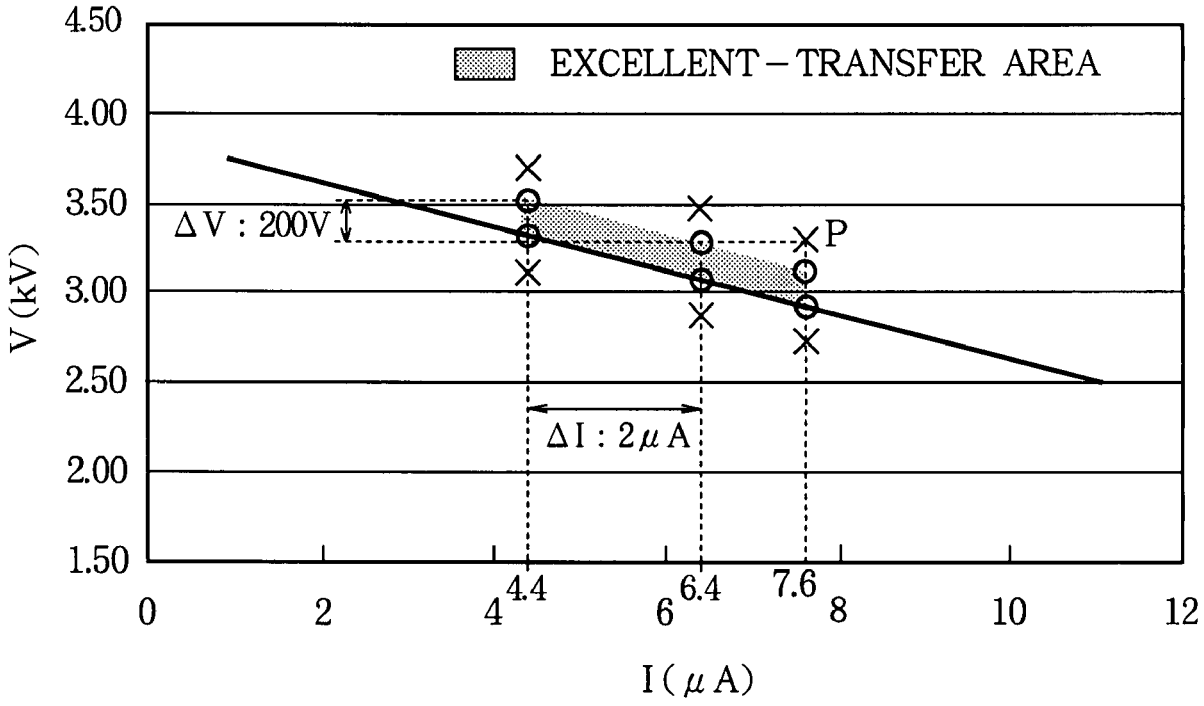
FIG. 9 is an illustrative view showing the relationship between the detected electric resistance value and the transfer voltage output value of the transfer roller.

FIG. 9 is an illustrative view showing the relationship between the detected electric resistance value I and the transfer voltage output value V of the transfer roller.

Figure 10:
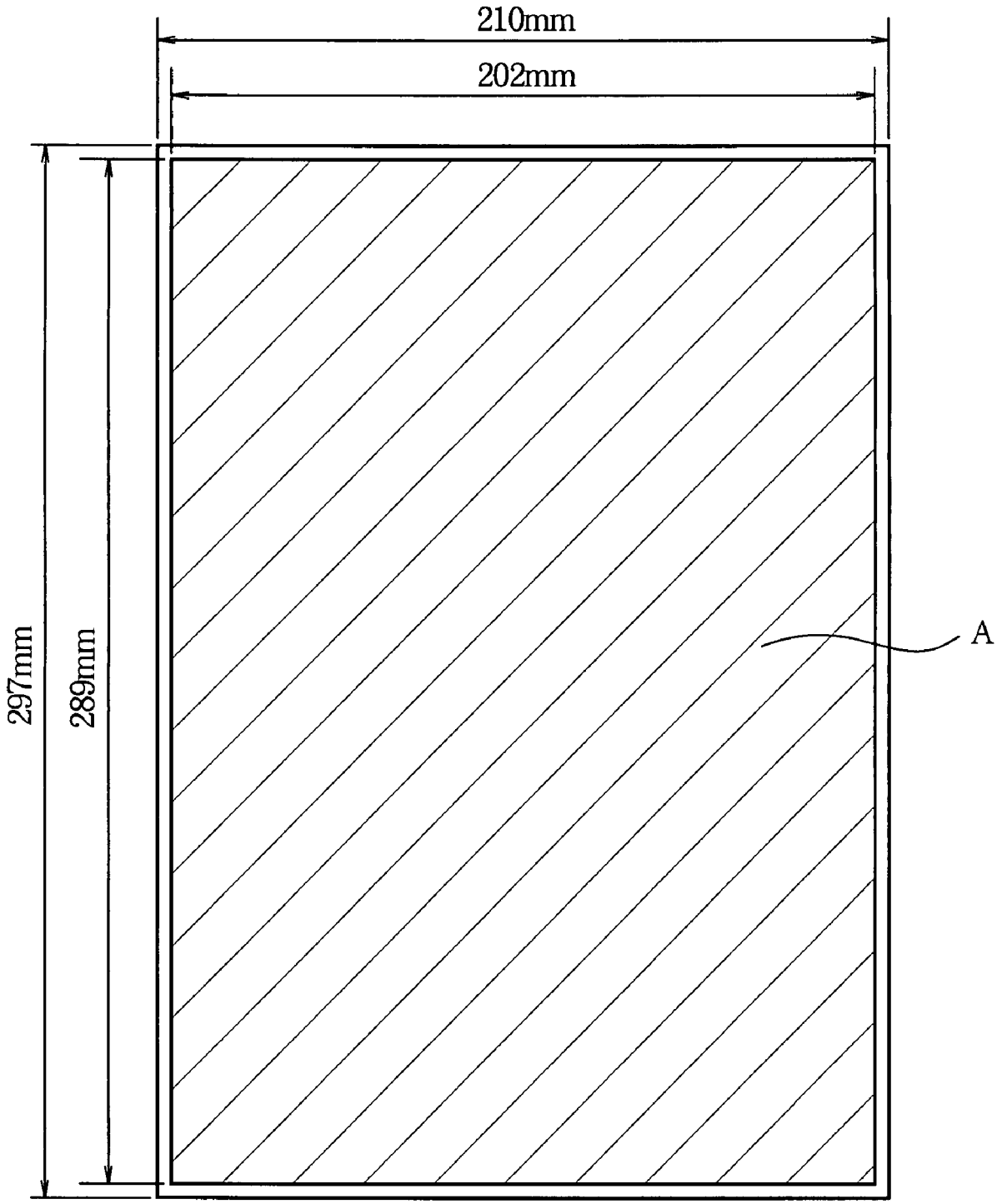
FIG. 10 shows an image forming area on a recording medium.

The relationship shown in FIG. 9 is obtained by the following printing test. First, solid images (100% image) of black (k), yellow (Y), magenta (M) and cyan (C) are respectively formed on the recording media of A4 size (297 mm×210 mm). An image forming area A (289 mm×202 mm) is defined on the surface of each recording medium as shown in FIG. 10. Then, the respective recording media are visually observed, and the image quality is evaluated. FIG. 11 shows the evaluation result of image quality. In FIG. 11, a mark "x" indicates that a defective image is observed, i.e., non-printed white spots appear in the image or the image exhibits a reduced color density. A mark "o" indicates that the above described defective image is not observed, i.e., an excellent image is formed. In FIG. 11, the detected electric resistance value I of the transfer roller is varied as 4.4 μA, 6.4 μA and 7.6 μA. For each detected electric resistance value I of the transfer roller, the transfer voltage output value V is varied in four ways.

The experimental result shown in FIG. 11 is expressed in the form of a graph showing the relationship between the detected electric resistance value I and the transfer voltage output value V as shown in FIG. 9. In FIG. 9, the meanings of the marks "x" and "o" are the same as those shown in FIG. 11.

In FIG. 9, a marked area indicates an excellent-transfer area in which an excellent image is formed (i.e., an excellent transforming is performed). In the case where the environment detection value E is 7 or 8, the relationship between the detected electric resistance value I (μA) and the transfer voltage output value V (kV) is generally expressed as the following equation (1).

$$V=-\alpha I+\beta \quad (1)$$

Here, α and β can take values respectively in the following ranges:

$0.09 \leqq \alpha \leqq 0.15$, and $3.7 \leqq \beta \leqq 4.2$.

In this embodiment, the following equation (2) is employed (α=0.123, β=3.86):

$$V=-0.123I+3.86 \quad (2)$$

The solid line shown in FIG. 9 corresponds to the above described equation (2).

From the result shown in FIG. 9, it is understood that the excellent-transfer range ΔV of the transfer voltage output value is 200V (ΔV=200 V).

It has been proved that, for example, when the power is turned ON after the printer is left for 6 hours or more under the environment of low temperature and low humidity (i.e., on condition that the environment detection value E is 7 or 8) so that the environment is stabilized, the detected electric resistance value I is 4.4 μA on average. When the initial detected electric resistance value I is set to be 4.4 μA, it is understood that the maximum detected electric resistance value I (corresponding to the excellent-transfer range ΔV of the transfer voltage output value of 200V) is 6.4 μA from FIG. 9. Therefore, the variation amount ΔI of the detected electric resistance value I of the transfer roller is found to be 2 μA (ΔI=2 μA).

Figure 12:
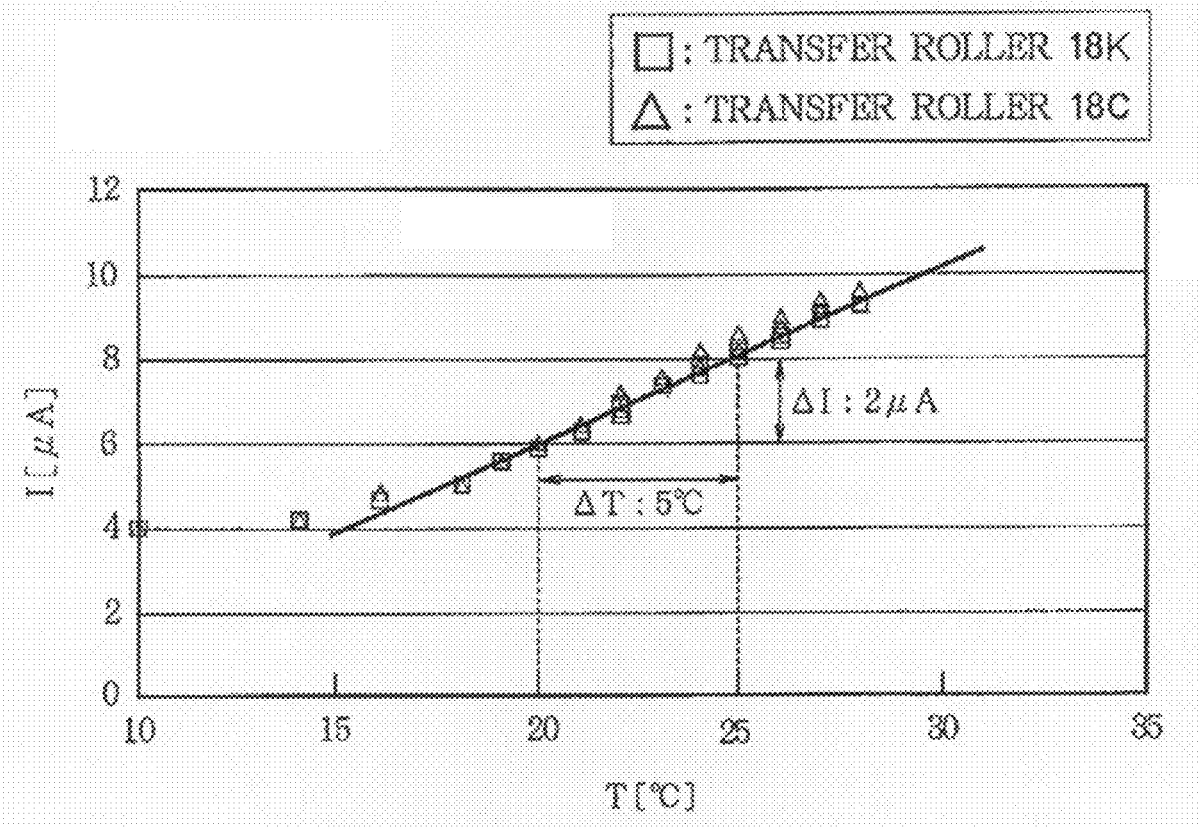
FIG. 12 is an illustrative view showing the relationship between the detected temperature value of the transfer belt and the detected electric resistance value of the transfer roller.

FIG. 12 is an illustrative view showing the relationship between the detected temperature value T of the transfer belt and the detected electric resistance value I of the transfer roller.

In FIG. 12, the detected electric resistance values I of the transfer roller 18K are indicated by mark "□", and the detected electric resistance values I of the transfer roller 18C are indicated by mark "Δ" for the detected temperature values T of the transfer belt 23. The solid line indicates the correlation between the detected temperature value T and the detected electric resistance values I of the transfer rollers 18K and 18C. The detected electric resistance values I of the respective transfer rollers 18K and 18C are in proportion to the detected temperature value T of the transfer belt 23. In FIG. 12, when the detected electric resistance values I of the transfer rollers 18K and 18C vary by the variation amount ΔI of 2 μA, the detected temperature value T of the transfer belt 23 varies by 5° C. Therefore, the variation amount of the detected temperature value T of the transfer belt 23 corresponding to the excellent-transfer range shown in FIG. 9 is less than or equal to 5° C.

Based on the above described result, the temperature variation threshold $\Delta T_{th}$ corresponding to the environment detection value E ranging from 7 to 8 is determined as 5° C. (i.e., $\Delta T_{th}$=5° C.). Similarly, the temperature variation threshold $\Delta T_{th}$ corresponding to the environment detection value E ranging from 3 to 6 is determined as 8° C. (i.e., $\Delta T_{th}$=8° C.), and the temperature variation threshold $\Delta T_{th}$ corresponding to the environment detection value E ranging from 1 to 2 is determined as 10° C. (i.e., $\Delta T_{th}$=10° C.), as shown in FIG. 6.

Next, the operation of the printer 10 in the case where the printing process is performed while controlling the transfer voltage will be described with reference to FIG. 13.

First, the operation of the printer 10 after the power activation or prior to the correction of a color shift (i.e., the printing process starting operation) will be described with reference to FIG. 13.

Figure 13:
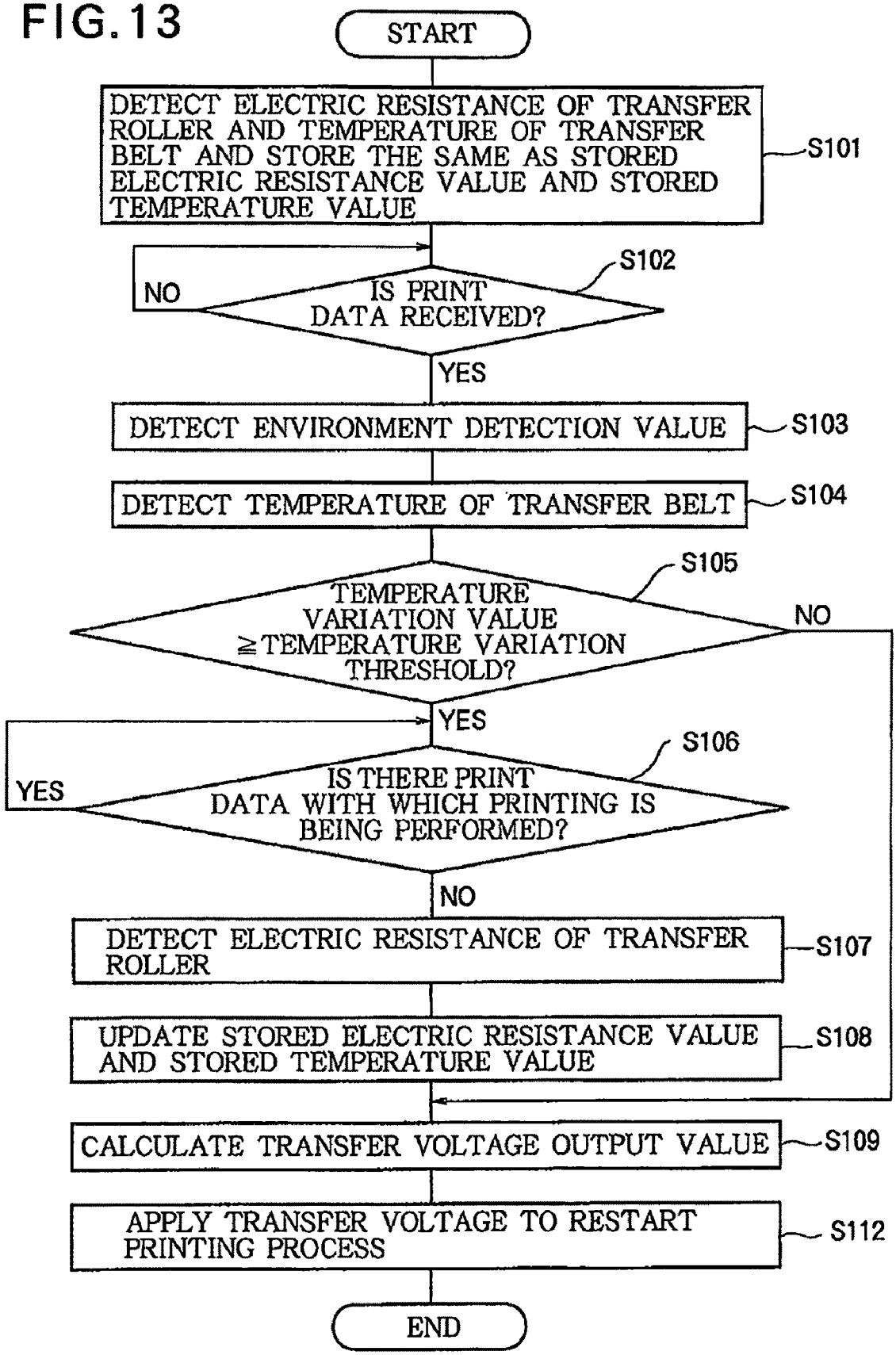
FIG. 13 is a flow chart showing a printing process starting operation of the printer according to the embodiment of the present invention.

FIG. 13 is a flow chart showing the printing process starting operation of the printer according to the embodiment of the present invention.

In the printer 10, after the power is turned on or before the correction of a color shift is performed, the printing control section 35 instructs the high-voltage control section 44 to detect the electric resistances of the respective transfer rollers 18K, 18Y, 18M and 18C. The high-voltage control section 44 controls the transfer voltage control section 47 so that the electric resistance detecting section 50 detects the electric resistances of the respective transfer rollers 18K, 18Y, 18M and 18C. The electric resistance detecting section 50 detects the electric resistances of the respective transfer rollers 18K, 18Y, 18M and 18C (as the detected electric resistance values), and then sends the detected electric resistance values to the printing control section 35 via the high-voltage control section 44. Then, the printing control section 35 controls the updating section 54 so that the storing section 53 stores these detected electric resistance values as the stored electric resistance values $I_{KO}$, $I_{YO}$, $I_{MO}$ and $I_{CO}$ (step S101).

Further, the printing control section 35 instructs the belt temperature determining section 40 to detect the temperature of the transfer belt 23. With this instruction, the belt temperature determining section 40 causes the belt temperature detecting sensor 27 to detect the temperature of the transfer belt 23. The belt temperature detecting sensor 27 detects the temperature of the transfer belt 23 as the detected temperature value, and sends the detected temperature value to the printing control section 35 via the belt temperature determining section 40. The printing control section 35 then controls the updating section 54 so that the storing section 53 stores the detected temperature value as the stored temperature value $T_O$ (step S101).

Next, the printer 10 enters a state of waiting for the print data, or the printer 10 completes the correction of the color shift and then enters a state of waiting for the print data (step S102).

In the state of waiting for the print data, when the host interface section 32 receives the print data (step S102), the instruction (command) to start printing is sent to the printing control section 35 via the command/image processing section 33.

On the receipt of the instruction, the printing control section 35 controls the environment detecting section 38 to detect the environment detection value E (step S103). The environment detecting section 38 detects the environment detection value E based on the respective detected values detected by the environmental-temperature detecting sensor 36 and the environmental-humidity detecting sensor 37 and the environment detection table 39, and notifies the printing control section 35 of the environment detection value E.

When the printing control section 35 receives the notification of the environment detection value E, the printing control section 35 reads the stored temperature value $T_O$ from the storing section 53. Further, the printing control section 35 notifies the belt temperature determining section 40 of the stored temperature value $T_O$ and the environment detection value E, and instructs to perform the detecting process of the temperature of the transfer belt 23 and the comparing-and-determining process.

On the receipt of the instruction, the belt temperature determining section 40 causes the belt temperature detecting sensor 27 to detect the detected temperature value T of the transfer belt 23 (step S104). Then, the calculating section 41 calculates the temperature variation value $\Delta T=|T-T_O$ based on the detected temperature value T having been detected and the stored temperature value $T_O$ having been notified.

Next, the comparing-and-determining section 43 chooses (and sets) the temperature variation threshold $\Delta T_{th}$ under the environmental condition inside the printer 10 based on the threshold storing section 42 (FIG. 6) and the environment detection value E notified by the printing control section 35. Then, the comparing-and-determining section 43 compares the temperature variation threshold $\Delta T_{th}$ and the temperature variation value $\Delta T$ calculated by the calculating section 41, and determines whether the temperature variation value $\Delta T$ is greater than or equal to the temperature variation threshold $\Delta T_{th}$ (step S105).

When the comparing-and-determining section 43 determines that the temperature variation value $\Delta T$ is greater than or equal to the temperature variation threshold $\Delta T_{th}$ (YES in step S105), the belt temperature determining section 40 notifies the printing control section 35 of the determination result and the detected temperature value T.

When the printing control section 35 receives the notification from the comparing-and-determining section 43, the printing control section 35 determines whether there is any print data with which the printing process is being performed (step S106). When the printing control section 35 determines that there is no print data with which the printing process is being performed, or when the printing process with the print data is completed, the printing control section 35 instructs the high-voltage control section 44 to detect the electric resistances of the transfer rollers 18K, 18Y, 18M and 18C. The high-voltage control section 44 controls the transfer voltage control section 47 so that the electric resistance detecting section 50 detects the electric resistances of the transfer rollers 18K, 18Y, 18M and 18C as the detected electric resistance values $I_K$, $I_Y$, $I_M$ and $I_C$ (step S107). The detected electric resistance values $I_K$, $I_Y$, $I_M$ and $I_C$ detected by the electric resistance detecting section 50 are sent to the printing control section 35 via the high-voltage control section 44.

Next, the printing control section 35 controls the updating section 54 to update the stored electric resistance values $I_{KO}$, $I_{YO}$, $I_{MO}$ and $I_{CO}$ respectively to the detected electric resistance values $I_K$, $I_Y$, $I_M$ and $I_C$, and to update the stored temperature value $T_O$ the detected temperature value T (step S108).

Further, the printing control section 35 notifies the high-voltage control section 44 of the environment detection value E and the medium information, and causes the high-voltage control section 44 to calculate the transfer outputs to be applied to the respective transfer rollers 18K, 18Y, 18M and 18C. The high-voltage control section 44 controls the transfer voltage control section 47 to cause the output control section 48 to calculate the transfer voltage output values. The output control section 48 refers to the transfer voltage table 52 (FIG. 8), and obtains the transfer voltage table, values $V_{K1}$, $V_{Y1}$, $V_{M1}$ and $V_{C1}$ for the transfer rollers 18K, 18Y, 18M and 18C based on the environment detection value E and the medium information. The output control section 48 further calculates the transfer voltage calculated values $V_{K2}$, $V_{Y2}$, $V_{M2}$ and $V_{C2}$ based on the stored electric resistance values $I_K$, $I_Y$, $I_M$ and $I_C$. Further, the output control section 48 adds the transfer voltage table values $V_{K1}$, $V_{Y1}$, $V_{M1}$ and $V_{C1}$ and the transfer voltage calculated values $V_{K2}$, $V_{Y2}$, $V_{M2}$ and $V_{C2}$, to obtain the transfer voltage output values $V_K$, $V_Y$, $V_M$ and $V_C$ to be applied to the respective transfer rollers 18K, 18Y, 18M and 18C (step S109).

Then, the printing control section 35 controls to start the printing process (step S112). The output applying section 49 is controlled by the high-voltage control section 44, and applies the transfer voltages of the transfer voltage output values $V_K$, $V_Y$, $V_M$ and $V_C$ to the respective transfer rollers 18K, 18Y, 18M and 18C for transferring the toner images to the recording medium 12. With this, the print starting process is completed.

In the above described step S105, if the comparing-and-determining section 43 determines that the temperature variation value $\Delta T$ is less than the temperature variation threshold $\Delta T_{th}$ (NO in the step S105), the printing control section 35 notifies the high-voltage control section 44 of the stored electric resistance values $I_{KO}$, $I_{YO}$, $I_{MO}$ and $I_{CO}$, the environment detection value E and the medium information, and causes the high-voltage control section 44 to calculate the transfer outputs to be applied to the respective transfer rollers 18K, 18Y, 18M and 18C. The output control section 48 obtains the transfer voltage table values $V_{K1}$, $V_{Y1}$, $V_{M1}$ and $V_{C1}$ from the transfer voltage table 52 based on the environment detection value E and the medium information. Further, the output control section 48 adds the transfer voltage table values $V_{K1}$, $V_{Y1}$, $V_{M1}$ and $V_{C1}$ to the transfer voltage calculated values $V_{K2}$, $V_{Y2}$, $V_{M2}$ and $V_{C2}$ for the transfer rollers 18K, 18Y, 18M and 18C having been calculated based on the stored electric resistance values $I_{K0}$, $I_{Y0}$, $I_{M0}$ and $I_{C0}$ (i.e., the transfer voltage calculated values having been calculated in the previous printing process) so as to obtain the transfer voltage output values $V_K$, $V_Y$, $V_M$ and $V_C$ (step S109). Then, the printing control section 35 controls to start the printing process (step S112).

Next, the operation of the printer 10 (i.e., the printing process restarting operation) in the case where the printing process is interrupted and a cleaning process of the charging rollers 14K, 14Y, 14M and 14C is performed will be described with reference to FIG. 14.

Figure 14:
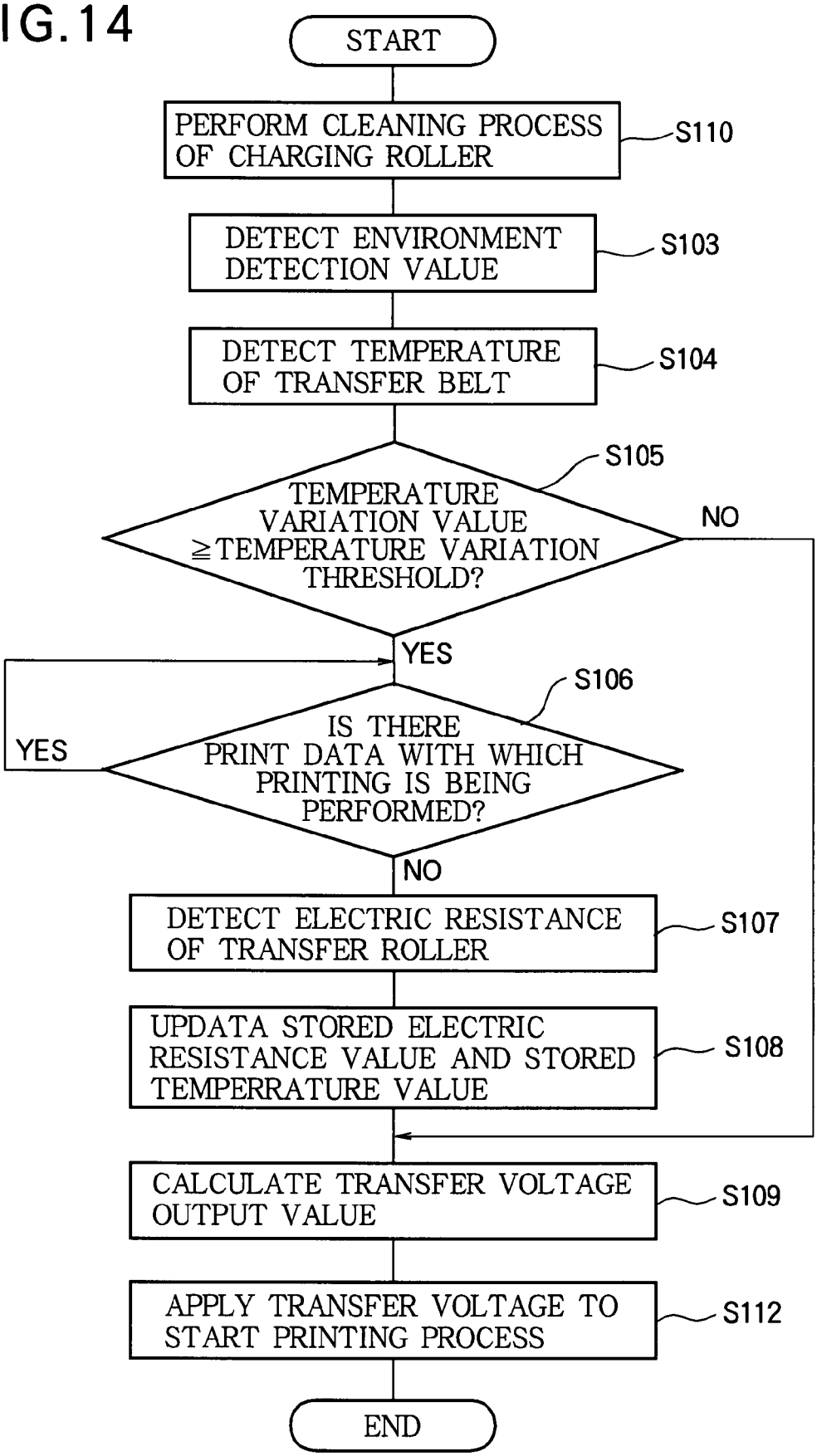
FIG. 14 is a flow chart showing a printing process restarting operation of the printer according to the embodiment of the present invention.

FIG. 14 is a flow chart showing the printing process restarting operation of the printer according to the embodiment of the present invention.

In the printing process of the printer 10, when the number of times of the transferring to the recording medium 12 exceeds the predetermined number (for example, 100 pages), the printing control section 35 interrupts the printing process and performs the cleaning process of the charging rollers 14K, 14Y, 14M and 14C (step S110).

When the cleaning process is completed, the printing control section 35 receives a notification of termination, and performs the respective processes (steps S103 to S109) from the detection of the environment detection value E (step S103) to the calculation of the transfer voltage output value (step S109) as is the case with the printing process staring operation (FIG. 13).

Then, the printing control section 35 restarts the printing process based on the calculated transfer voltage output value (step S112). The output applying section 49 controls the high-voltage control section 44 to apply the transfer voltages to the respective transfer rollers 18K, 18Y, 18M and 18C for transferring the toner images to the recording medium 12. With this, the printing process is restarted.

As described above, the printer according to this embodiment determines whether the transfer output is appropriate or not based on the variation amount of the temperature of the transfer belt. Only when the printer determines that the variation amount is not appropriate, the printer detects the electric resistances of the transfer rollers and applies the transfer outputs to the transfer rollers based on the electric resistances. Accordingly, it becomes possible to control the transfer output based on the variation of the electric resistance values, and to omit the time required for ineffectual detecting process, with the result that the processing time can be shortened. Further, the threshold (set corresponding to the variation amount of the temperature) can be changed according to the environmental condition in the printer, and the transfer output can be corrected, with the result that an excellent image formation can be performed by means of the optimum transferring output.

Further, in a conventional controlling system, for example, the transfer voltage output value of 3.32 kV is applied at the detected electric resistance value of 4.4 μA in FIG. 9. If the detection of the transfer current is not performed (for example, during the continuous printing operation), the transfer voltage output value V is not corrected, and therefore the transfer voltage output value V may be out of the excellent-transfer area (see, a point P in FIG. 9). As a result, there is a problem that a defective image may be formed. For example, non-printed white spots appear in the image or the image exhibits a reduced color density.

In contrast, according to the controlling system of this embodiment, when it is determined that the transfer output is not appropriate (based on the variation amount of the temperature of the transfer belt), the electric resistance value of the transfer roller is detected to thereby correct the transfer voltage output value. Therefore, it is possible to apply the transfer voltage output value V of 2.92 kV in the excellent-transfer range at the detected electric resistance value I of 7.6 μA. Therefore, according to this embodiment, it becomes possible to prevent the occurrence of the above described defective image.

In this embodiment, the belt temperature detecting sensor 27 for detecting the temperature of the transfer belt 23 is disposed on the position shown in FIGS. 2 and 4. However, the present invention is not limited to this example.

Figure 15:
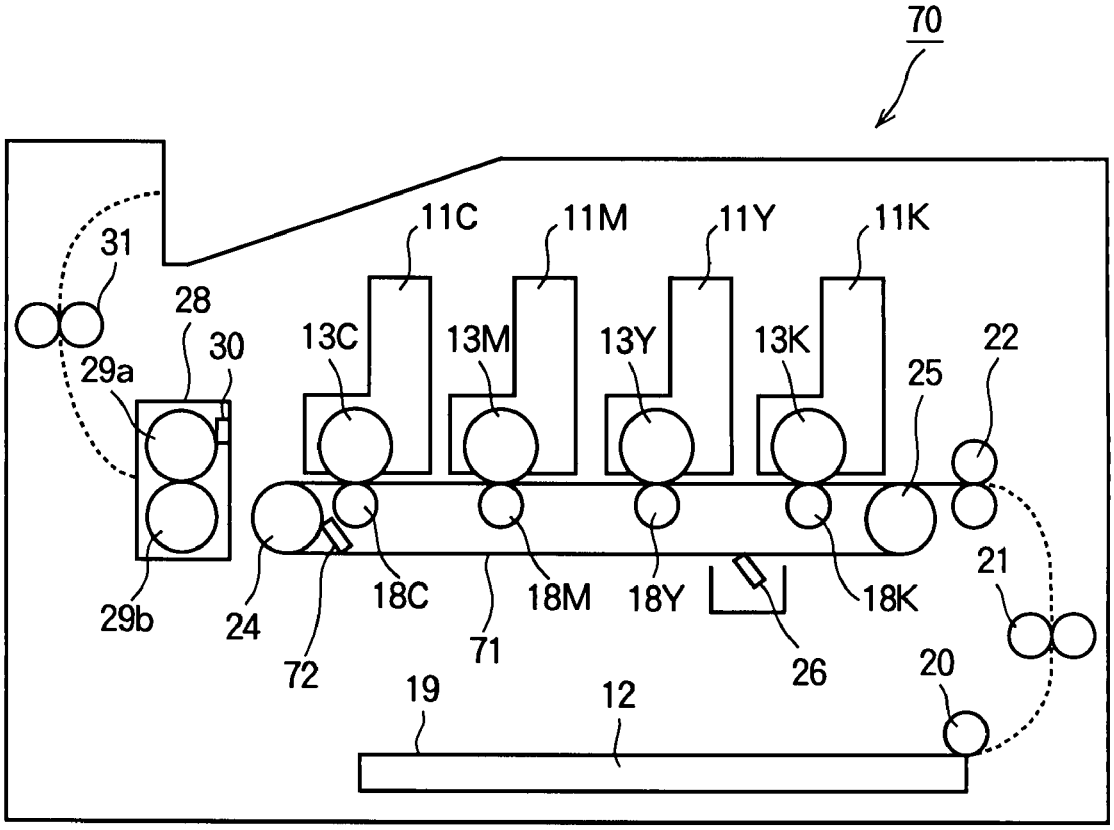
FIG. 15 is a schematic view showing a configuration of a modification of the embodiment of the present invention.
Figure 16:
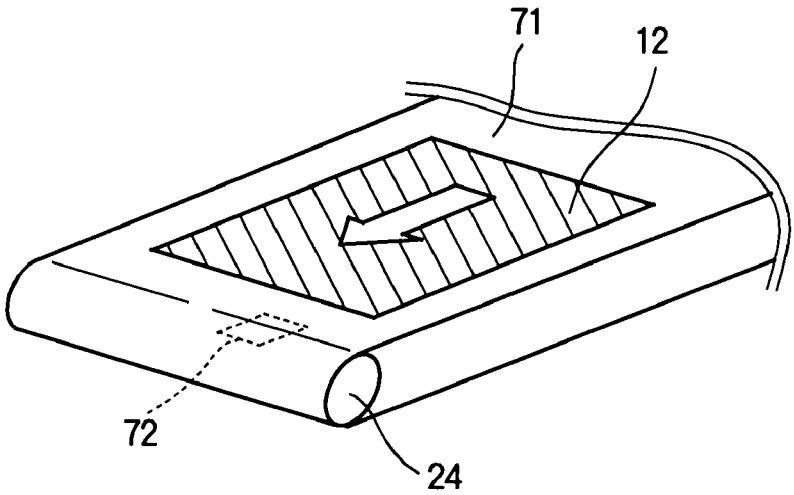
FIG. 16 is an illustrative view showing a position of a belt temperature detecting sensor according to the modification of the embodiment of the present invention.

FIG. 15 is a schematic view showing the configuration of the printer according to the modification of the embodiment of the present invention. FIG. 16 is an illustrative view showing the position of the belt temperature detecting sensor according to the modification of the embodiment of the present invention.

In the printer 70 according to the modification, the belt temperature detecting sensor 72 is disposed in contact with the inner surface of the transfer belt 71 at the lower part of the transfer belt 71 as shown in FIG. 15. Further, the belt temperature detecting sensor 72 is disposed at the center portion in the direction of the rotation axis of the driving roller 24 as indicated by a dashed line in FIG. 16. The belt temperature detecting sensor 72 is disposed on a portion of the transfer belt 23 that does not contact the recording medium 12. Therefore, it becomes possible to prevent the defective transferring due to the abrasion of the transfer belt 71 and the adhesion of the toner to the belt temperature detecting sensor 72. Further, since the belt temperature detecting sensor 72 is disposed at the center portion, unbalanced temperature detection can be prevented.

In the above description, the present invention is applied to the printer. However, the present invention is applicable to a facsimile, a copier, a color printer or the like.

In the above description, the electric resistance value of the transfer roller (the transfer unit) is expressed in "μA" because the electric resistance value can be evaluated by detecting the current flowing through the transfer roller while applying a predetermined voltage to the transfer roller (see the description of the electric resistance detecting section 50).

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

an image bearing body that bears a developer image;

a transfer member for transferring said developer image to a recording medium;

a storing section that preliminarily stores a stored temperature value and a stored electric resistance value of said transfer member;

a temperature detecting section that detects a temperature of said transfer member;

a calculating section that calculates a temperature variation value representing a variation between a detected temperature value detected by said temperature detecting section and said stored temperature value stored in said storing section;

a comparing-and-determining section that compares said temperature variation value and a predetermined temperature variation threshold and determines whether said temperature variation value is less than said temperature variation threshold or not;

an output control section that determines a transfer output based on said stored electric resistance value stored in said storing section, in the case where said comparing-and-determining section determines that said temperature variation value is less than said temperature variation threshold, and an output applying section that applies said transfer output to said transfer member.

2. The image forming apparatus according to claim 1, further comprising:

an electric resistance detecting section that detects an electric resistance of said transfer member when said comparing-and-determining section determines that said temperature variation value is greater than or equal to said temperature variation threshold, and an updating section that updates said stored electric resistance value stored in said storing section to said detected electric resistance value detected by said electric resistance detecting section, and updates said stored temperature value stored in said storing section to said detected temperature value detected by said temperature detecting section, wherein said output control section determines a transfer output further based on said updated stored electric resistance value.

3. The image forming apparatus according to claim 1, further comprising an environment detecting section that obtains an environment detection value representing an environmental condition in said image forming apparatus, wherein said output control section determines a transfer output further based on said environment detection value and a medium information of said recording medium.

4. The image forming apparatus according to claim 3, further comprising:

an environmental-temperature detecting section that detects an environmental-temperature in said image forming apparatus, an environmental-humidity detecting section that detects an environmental-humidity in said image forming apparatus, wherein said environment detecting section obtains said environment detection value based on said environmental-temperature and said environmental-humidity.

5. The image forming apparatus according to claim 3, wherein said medium information includes a medium-type information representing a type of said recording medium and a medium-thickness information representing a thickness of said recording medium.

6. The image forming apparatus according to claim 1, further comprising:

an environment detecting section that obtains an environment detection value representing an environmental condition in said image forming apparatus, and a threshold storing section that stores said environment detection value and a temperature variation threshold corresponding to said environment detection value, wherein said comparing-and-determining section chooses a corresponding temperature variation threshold from said threshold storing section based on said environment detection value obtained by said environment detecting section.

7. The image forming apparatus according to claim 6, further comprising:

an environmental-temperature detecting section that detects an environmental-temperature in said image forming apparatus, an environmental-humidity detecting section that detects an environmental-humidity in said image forming apparatus, wherein said environment detecting section obtains said environment detection value based on said environmental-temperature and said environmental-humidity.

8. The image forming apparatus according to claim 1, wherein said transfer member comprises:

a feeding member that feeds said recording medium to said image bearing body, and a transfer unit disposed in opposition to said image bearing body, wherein said temperature detecting section detects a temperature of said feeding member, and said output applying section applies said transfer output to said transfer unit.

9. The image forming apparatus according to claim 8, wherein said temperature detecting section is disposed in opposition to a portion of said feeding member that does not contact said recording medium.

* * * * *